US005607805A

United States Patent [19]

Semura et al.

[11] Patent Number: 5,607,805

[45] Date of Patent: Mar. 4, 1997

[54] TONER FOR ELECTROPHOTOGRAPHY AND DEVELOPER COMPOSITION CONTAINING THE SAME

[75] Inventors: Tetsuhiro Semura; Eiji Morimoto, both of Wakayama, Japan

[73] Assignee: Kao Corporation, Tokyo, Japan

[21] Appl. No.: 498,343

[22] Filed: Jul. 5, 1995

[30] Foreign Application Priority Data

Jul. 18, 1994 [JP] Japan ..... 6-188882

[51] Int. Cl.[6] ..... G03G 9/083

[52] U.S. Cl. ..... 430/106.6; 430/109; 430/137

[58] Field of Search ..... 430/106.6, 109, 430/110

[56] References Cited

U.S. PATENT DOCUMENTS

| | | | |
|---|---|---|---|
| 2,221,776 | 11/1940 | Carlson | 430/67 |
| 2,297,691 | 10/1942 | Carlson | 430/121 |
| 2,357,809 | 9/1944 | Carlson | 95/11 |
| 4,387,211 | 6/1983 | Yasuda et al. | 528/179 |
| 4,657,837 | 4/1987 | Morita et al. | 430/109 |
| 5,234,787 | 8/1993 | Morimoto et al. | 430/106.6 |

OTHER PUBLICATIONS

English Abstract of JP-A-57-109825.

English Abstract of JP-B-59-11902.

*Primary Examiner*—John Goodrow

*Attorney, Agent, or Firm*—Birch, Stewart, Kolasch & Birch, LLP

[57] ABSTRACT

A toner for electrophotography includes at least a binder resin and a colorant, the binder resin containing a linear polyester as a main component and having a pulverization index of from 14 to 40 obtained by a given method. A developer composition includes the above toner for electrophotography.

10 Claims, No Drawings

TONER FOR ELECTROPHOTOGRAPHY AND DEVELOPER COMPOSITION CONTAINING THE SAME

BACKGROUND OF THE INVENTION

1. Field of the Invention

The present invention relates to a toner for electrophotography and a developer composition containing the toner. More specifically, the present invention relates to a toner for electrophotography having excellent transparency and excellent surface smoothness of a fixed image demanded particularly for a color toner, and a developer composition containing such a toner.

Further, the present invention relates to a nonmagnetic toner for electrophotography used in a non-contact heat-fixing method and a developer composition containing such a toner.

2. Discussion of the Related Art

As disclosed in U.S. Pat. Nos. 2,221,776, 2,297,691, and 2,357,809 and other publications, conventional electrophotography comprises the steps of evenly charging a photoconductive insulating layer (a charging process); subsequently exposing the layer to eliminate the charge on the exposed portion, to thereby form an electrostatic latent image (an exposing process); visualizing the formed image by adhering colored charged fine powder, known as a toner, to the latent image (a developing process); transferring the obtained visible image to an image-receiving sheet such as a transfer paper (a transfer process); and permanently fixing the transferred image by heating, pressure application or other appropriate means of fixing (a fixing process).

Developing methods suitably used for the above electrophotographic methods can be roughly classified into dry-type developing methods and wet-type developing methods. The dry-type developing methods may be further classified into a developing method using a one-component developer and a developing method using a two-component developer, depending upon whether or not a carrier is used in the developer composition.

A color electrophotography using a color developer can be basically carried out by repeating the above processes of charging, exposing, developing, and transferring for a plural number of times, and subsequently fixing the transferred image, to thereby give a color fixed image.

When using a two-component dry-type developer, in the above developing process, toners are generally blended with carrier particles such as iron powders in a developing unit to thereby generate electrostatic charges in the toners by the frictional forces. At this time, brittle toners, namely toners having small pulverization indices, are likely to break upon the friction with the carrier particles when used for a long period of time, to thereby form fine particle toners, and the fine particle toners are likely to be adhered to the carrier surface. Further, since the fine particle toners are melt-fused with the carrier particles, the charge-supplying function of the carrier is lowered, which in turn results in the lowering of the triboelectric charges of the toners. As a result, the poorly charged toners are likely to be scattered, thereby causing background in the formed images.

On the other hand, as for binder resins for toner used for copy machines utilizing conventional non-contact heat-fixing methods such as an oven fixing method and a flash fusing method, resins which quickly fuse upon application of heat, etc. are required, so that a low-molecular weight binder resin is suitably used. However, since a low-molecular weight binder resin is likely to produce a brittle toner, similar problems to those mentioned above are likely to take place. Therefore, styrene-acrylic resins presently used as a main binder resin for electrophotography share these problems.

Particularly in the case where a nonmagnetic one-component developer is used, a thin toner layer is usually formed on a developer sleeve by a thin layer-forming blade. However, when a brittle toner is used, toner undesirably is fused on the developer sleeve upon the thin layer formation, so that the image quality of the formed images is lowered.

From the above, a development of a binder resin for toners which has excellent impact resistance and gives high quality image even in the long-term use is in demand.

On the other hand, as the copying machines are more generalized, they are highly likely to be used under severe environmental conditions, for instance, under high-temperature, high-humidity conditions or under low-temperature, low-humidity conditions. Therefore, a toner capable of obtaining formed images as clear as those obtained under normal conditions even under such severe environmental conditions is becoming increasingly crucial.

There are many toners where the electric properties largely varied in triboelectric charges and insulation resistance under high-temperature, high-humidity conditions or low-temperature, low-humidity conditions, thereby resulting in the deterioration of the formed images, even though the electric properties are in preferred ranges for the normal environmental conditions. For instance, under the low-temperature, low-humidity conditions, the image density of the formed images is lowered, and under the high-temperature, high-humidity conditions, the image density of the formed images becomes high. In the case where the triboelectric charges are remarkably lowered, most of the solid image portions contain color-eliminated inner portion. Particularly in the case of a polyester having at each end hydrophilic carboxyl groups and hydroxyl groups, when the concentration of the groups is high, namely an acid value thereof and a hydroxyl value thereof are high, the resulting toner made of the polyester is easily affected by the environmental conditions.

Therefore, a toner which is capable of forming clear fixed images in all environmental conditions is in demand, to thereby form fixed images no different from those obtained under normal environmental conditions.

Also, in a full-color electrophotography, by carrying out the developing method for a number of times, various toner layers with different colors are laminated on the same image-receiving member. In the color electrophotography, the following criteria are required for binder resins for toners.

(1) The fixable toner obtained therefrom has to be in a completely melting state completely losing the original shape of the toner particles so as not to inhibit the color reproducibility by optically diffused reflection.

(2) Binder resin has to have a good transparency so as not to inhibit the toning of the under toner layers having different colors among the laminated toner layers.

As mentioned above, the binder resins for toners used in full-color copy machines not only have to have a wide fixing temperature region, but also good transparency and flatness of the fixed image surface upon fixing. Therefore, in addition to the properties required for binder resins for toners used in mono-color copy machines, such as a wide fixing temperature region and high offset resistance, more criteria have been required.

Therefore, an improved method in offset resistance for a mono-color toner cannot simply be applied for a binder resin for a full-colored toner. For instance, methods of improving offset resistance by forming a three-dimensional structure in the polyester by using polycarboxylic acids are disclosed in Japanese Patent Laid-Open No. 57-109825 and Japanese Patent Examined Publication No. 59-11902. However, in these methods, although the offset resistance can be improved, since the amount of acid components for crosslinking becomes large, the resulting toner has a large elasticity, so that the fixed image surface would not become flat in a relatively low temperature region, thereby causing problems in color reproducibility when used as a full-colored toner.

As explained above, it has been conventionally extremely difficult to satisfy the properties of having a suitable hardness, having basic toner characteristics, such as a triboelectric stability and a low-temperature fixing ability, and also having full-colored toner characteristics, such as transparency and smoothness of the fixed image surface, all at the same time.

SUMMARY OF THE INVENTION

An object of the present invention is to provide a toner for electrophotography which has excellent impact resistance, thereby maintaining a high-image quality of the formed images in its long-term use even under severe environmental conditions such as low-temperature, low-humidity conditions and high-temperature, high-humidity conditions, and is capable of fixing at a low temperature to form a smooth fixed image surface with high transparency; and a developer composition containing the above toner.

Another object of the present invention is to provide a toner for electrophotography which is capable of preventing the generation of fine toner particles and maintaining high-image quality of the formed images in its long-term use by giving a low molecular binder resin required for a non-contact heat-fixing method a suitable hardness; and a developer composition containing the above toner.

As a result of intensive research in view of solving the above-mentioned problems, the present inventors have found that by using a particular binder resin with given properties for a toner, the above objects can be achieved, and have thus completed the present invention.

The present invention is concerned with the following:

(1) A toner for electrophotography comprising at least a binder resin and a colorant, the binder resin containing a linear polyester as a main component and having a pulverization index of from 14 to 40;

(2) The toner for electrophotography described in (1) above, wherein the linear polyester is obtainable by a condensation polymerization between an alcohol component and an acid component containing an aliphatic dicarboxylic acid in an amount of not less than 40 mol % of the entire acid component;

(3) The toner for electrophotography described in (1) or (2) above, wherein the linear polyester has an acid value of not more than 40 KOH mg/g and a hydroxyl value of not more than 40 KOH mg/g;

(4) The toner for electrophotography described in any one of (1) to (3) above, wherein the linear polyester has a softening temperature determined by a koka-type flow tester of from 80° C. to 120° C., a temperature difference between a flow beginning temperature and the softening temperature being from 10° to 40° C.;

(5) The toner for electrophotography described in any one of (1) to (4) above, wherein the toner for electrophotography is a color toner for electrophotography; and (6) A developer composition comprising a magnetic carrier and the toner for electrophotography described in any one of (1) to (5) above.

When the toner for electrophotography or the developer composition of the present invention is used, since the toner has excellent impact resistance, a high-image quality of the formed images can be maintained during a long period of time, and the resulting formed images are very little affected even under severe environmental conditions such as low-temperature, low-humidity conditions and high-temperature, high-humidity conditions. Also, the toner is capable of fixing at a low temperature to form a smooth fixed image surface with high transparency.

DETAILED DESCRIPTION OF THE INVENTION

In a toner for electrophotography comprising at least a binder resin and a colorant, the toner for electrophotography is characterized in that the binder resin contains a linear polyester as a main component and has a pulverization index of from 14 to 40.

Here, the linear polyester is a polyester having a structure comprising a linear main chain and a relatively short side chain linked to the main chain. The linear polyester is produced by a condensation polymerization of divalent monomers without using a trivalent or higher polyvalent monomers or other crosslinking agents.

In the present invention, the reasons for using the linear polyester as a main component of the binder resin as mentioned above are as follows. When a crosslinking density is increased by using trivalent or higher polyvalent monomers as a crosslinking component, the elasticity of the polyester becomes large and the melting rate becomes low, thereby deteriorating smoothness of the fixed image surface.

The linear polyester can be usually obtained by a condensation polymerization between a dihydric alcohol monomer and a dicarboxylic acid monomer.

Among the monomers constituting the linear polyester in the present invention, examples of the dihydric alcohol monomers include aliphatic diols, such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol; bisphenol A; hydrogenated bisphenol A; alkylene oxide adducts of bisphenol A, such as polyoxypropylene(2.2)-2,2-bis(4-hydroxyphenyl)propane and polyoxyethylene(2.2)-2,2-bis(4-hydroxyphenyl)propane; and other dihydric alcohols. Among them, a preference is given to ethylene glycol, polyoxypropylene(2.2)-2,2-bis(4-hydroxyphenyl)propane, and polyoxyethylene(2.2)-2,2-bis(4-hydroxyphenyl)propane.

As for the acid components, examples of the dicarboxylic acid components include aliphatic unsaturated dicarboxylic acids, such as maleic acid, fumaric acid, citraconic acid, itaconic acid, glutaconic acid, and alkenylsuccinic acids, such as n-dodecenylsuccinic acid; aliphatic saturated dicarboxylic acids, such as succinic acid, adipic acid, sebacic acid, azelaic acid, malonic acid, and alkylsuccinic acids, such as n-dodecylsuccinic acid; aromatic dicarboxylic acids, such as phthalic acid, isophthalic acid, and terephthalic acid; and alicyclic dicarboxylic acids, such as cyclohexanedicarboxylic acid; acid anhydrides thereof, alkyl esters thereof, and other dicarboxylic acid components.

The linear polyester in the present invention is preferably obtained by using monomers containing saturated or unsaturated aliphatic dicarboxylic acid in the condensation polymerization in an amount of not less than 40 mol % of the entire acid component, more preferably not less than 50 mol % and not more than 100 mol %. When the amount of the aliphatic dicarboxylic acid is less than 40 mol %, the resulting polyester resin becomes brittle and the fixing ability of the toner obtained is likely to be poor. The reasons for using the aliphatic dicarboxylic acid as an effective acid component for the linear polyester in the present invention are as follows. When the resin contains a large number of flexible segments thereof, the number-average molecular weight (Mn) of the obtained polyester becomes larger when compared with the case where an aromatic dicarboxylic acid is used for the production of the polyester, and a hard resin having a large pulverization index can be obtained while maintaining a low softening temperature.

The linear polyester in the present invention can be polymerized by generally known esterification or transesterification of the above monomers. Specifically, a condensation polymerization may be carried out at a temperature of from 170° to 220° C. and a pressure of 5 mmHg to a normal pressure while suitably using a catalyst, etc., the optimum temperature and pressure being determined by the reactivity of the monomers, and the polymerization reaction is terminated at a point where given properties are reached.

The pulverization index of the binder resin in the present invention is normally from 14 to 40, preferably from 14 to 30. When the pulverization index of the binder resin is less than 14, cracking of the obtained toner takes place by the impact upon the contact with the carrier in a toner developing unit as mentioned above, and thereby toner spent is likely to be generated. Therefore, the background is likely to take place due to the decrease in triboelectric charge. Further, particularly in the case of a nonmagnetic one-component dry-type developing method, when the pulverization index is less than 14, the toner is likely to be fused on the developer sleeve upon forming a thin layer of a toner on a developer sleeve, thereby deteriorating the image quality of the resulting formed images. On the other hand, when the pulverization index exceeds 40, a binder resin is so tough that the pulverizability is likely to be poor, thereby significantly reducing the productivity upon the toner production.

Here, the pulverization index refers to a value obtained by the following method. The resin pulverized by a generally known pulverization method is classified to obtain a 16-mesh pass and 20-mesh on resin powder. The classified resin powder is accurately weighed in an amount of 10.00 g, and then placed, for instance, in a coffee mill (HR-2170, manufactured by PHILIPS) to pulverize the resin powder for 10 seconds. Thereafter, the pulverized resin powder is classified with a 30-mesh opening sieve, and the weight of 30-mesh on resin powder (A) expressed in grams is accurately weighed. The residual ratio is calculated by the following equation from the value of A.

$$\text{Residual Ratio (\%)} = \frac{(A)\ \text{g}}{\text{Weight of Resin before Coffee Mill Pulverization}} \times 100$$

The above operation is repeated for a total of three times, and the obtained values are averaged, to thereby give a pulverization index. In other words, the pulverization index is an average value of the three residual ratios. By employing the pulverization index mentioned above, the pulverizability of the binder resin used for toner can be easily determined, and the value is highly reproducible.

The binder resin used in the present invention comprises the linear polyester mentioned above as the main component, and the binder resin may be used together with other resins such as styrene-acrylic resins in an amount so as not to impair the effects of the present invention. The amount of the linear polyester used in the present invention is normally 70 to 100% by weight, preferably 90 to 100% by weight of the entire binder resin. Therefore, in order to obtain the binder resin with the pulverization index mentioned above, the pulverization index of the linear polyester contained as the main component thereof is also preferably from 14 to 40.

Conventionally used linear polyesters generally have pulverization indices of less than 14. In the present invention, by using aliphatic dicarboxylic acids as acid component monomers in a given amount, a linear polyester having a pulverization index remarkably higher than those of the conventional products is obtained.

The linear polyester in the present invention has an acid value of preferably not more than 40 KOH mg/g, and a hydroxyl value of preferably not more than 40 KOH mg/g. More preferably, the acid value thereof is not more than 25 KOH mg/g, and the hydroxyl value is not more than 25 KOH mg/g. When the acid value or the hydroxyl value exceeds 40 KOH mg/g, the linear polyester is easily influenced by the environmental conditions in cases of being subjected to high-temperature, high-humidity environmental conditions and low-temperature, low-humidity environmental conditions, thereby resulting in the deterioration of the formed images.

Incidentally, the acid value and the hydroxyl value of the polyester resin in the present invention is determined by a method according to JIS K 0070.

In the present invention, in order to satisfy the thermal properties, which are crucial properties required for toners, the molecular weight of the resin used has to be controlled to a given range, and the molecular weight is defined based on the softening temperature determined by koka-type flow tester and the temperature difference between the flow beginning temperature and the softening temperature, the flow beginning temperature being determined upon measurement of the softening temperature. Specifically, the linear polyester preferably has a softening point determined by koka-type flow tester controlled to a range of from 80° to 120° C., and a temperature difference between the flow beginning temperature and the softening temperature controlled to a range of from 10° to 40° C. More preferably, the softening point is controlled to a range of from 90° to 110° C., and the temperature difference between the flow beginning temperature and the softening temperature is controlled to a range of from 15° to 35° C.

When the softening temperature of the linear polyester is less than 80° C., the resulting toner is likely to have poor offset resistance and blocking resistance. When the softening temperature exceeds 120° C., the resulting toner is likely to have poor low-temperature fixing ability. In addition, as in the case of the softening temperature, when the temperature difference between the flow beginning temperature and the softening temperature of the linear polyester is less than 10° C., the resulting toner is likely to have poor offset resistance and blocking resistance. When the temperature difference exceeds 40° C., the resulting toner is likely to have poor low-temperature fixing ability.

Here, the koka-type flow tester is a device which can measure with high reproducibility the melting behavior of the resins, etc. at each temperature and thus being extremely effective in evaluating the binder resin for toner. The koka-type flow tester is briefly described in JIS K 7210, and more detailed method used in the present invention is detailed below. A koka-type flow tester (manufactured by Shimadzu Corporation) is used, in which a 1 $cm^3$ sample is extruded through a nozzle having a dice pore size of 1 mm and a length of 1 mm, while heating the sample at a heating rate of 6° C./min and applying a load of 20 $kg/cm^2$ thereto with the plunger. An S-shaped curve showing the relationship between the downward movement of a plunger (flow length) and temperature is drawn. When the height of the S-shaped curve is defined as h, the temperature corresponds to one-half of the height (h/2, the temperature at which one-half of the resin is flowed) is defined as the softening point. Also, the flow beginning temperature refers to a temperature at which the resin begins melting, to thereby cause the downward movement of the plunger.

The toner of the present invention contain the binder resin as explained above and further a colorant as an essential component. Besides them, the toner contains a charge control agent, and optionally an offset inhibitor and a fluidity improver.

Examples of the colorants for color toners usable in the present invention include phthalocyanine; monoazo pigments such as C.I. Pigment Red 5, C.I. Pigment Orange 36, and C.I. Pigment Red 22; diazo pigments such as C.I. Pigment Yellow 83; anthraquinone pigments such as C.I. Pigment Blue 60; diazo dyes such as Solvent Red 19; and rhodamine dyes such as Solvent Red 49.

In addition, the colorants for color toner used in the non-contact heat-fixing method in the present invention may be those colorants mentioned above. In the case of preparing black toners, various carbon blacks prepared by a thermal black method, an acetylene black method, and a channel black method, and a grafted carbon black, in which the surface of carbon black is coated with a resin may be used.

Further, when a magnetic toner used in non-contact heat-fixing method is prepared, examples of the particulate magnetic materials include ferromagnetic metals such as iron, cobalt, or nickel, alloys, and compounds containing these elements, such as ferrite, hematite, or magnetite. Such a magnetic material is in the form of a fine powder having an average particle size of 0.1 to 1 μm. The magnetic material is preferably dispersed in an amount of about 30 to 70 parts by weight, based on 100 parts by weight of the binder resin.

Examples of positive charge control agents used in the present invention are not particularly limited, including a wide variety of compounds ranging from low-molecular compounds to high-molecular compounds, including polymers. Examples thereof include nigrosine dyes such as "Nigrosine Base EX" (manufactured by Orient Chemical Co., Ltd.), "Oil Black BS" (manufactured by Orient Chemical Co., Ltd.), "Oil Black SO" (manufactured by Orient Chemical Co., Ltd.); triphenylmethane dyes; quaternary ammonium salt compounds; and vinyl polymers having an amino group.

Example of negative charge control agents include metal complex salts of monoazo dyes; nitrohumic acid and salts thereof; compounds containing one or more nitro groups or one or more halogen atoms; and copper phthalocyanine sulfonate; maleic anhydride copolymers.

Further, in the color toner for electrophotography, for the purpose of improving the formed images or depending on a developing mechanism, particulate magnetic materials may be incorporated in the toner. Examples of the particulate magnetic materials include alloys and compounds containing elements having ferromagnetic properties such as ferrite or magnetite. Such a magnetic material is in the form of a fine powder having an average particle size of 0.05 to 1 μm. The magnetic material is preferably dispersed in an amount of about 0.05 to 10.00% by weight in the binder resin.

The toner of the present invention may further include various known property modifiers such as offset inhibitors, fluidity improvers, and thermal property improvers such as metal complexes including chromium complexes of 3,5-di-tert-butylsalicylates and metal oxides such as zinc oxide. The property modifiers may be used in suitable amounts so as not to inhibit the effects of the present invention.

The toner of the present invention may be produced by any of conventionally known production methods such as a blending and pulverization method, a spray-drying method, a polymerization method. For instance, the toner of the present invention may be generally produced by steps of uniformly dispersing and mixing a binder resin, a colorant, a charge control agent, and the like in a known mixer such as a ball-mill, melt-blending the obtained mixture in a sealed kneader or a single-screw or twin-screw extruder, cooling the extruded mixture, pulverizing the cooled mixture, and classifying the pulverized mixture. In addition, additives such as fluidity improvers may be optionally added to the toner.

The obtained product is a colored powder having an average particle size of 5 to 15 μm, namely the toner for electrophotography of the present invention, which may be used without further treatment as a one-component system developer. In addition, in the case of producing a dry-type two-component system developer composition, the above toner may be blended with an appropriate amount of magnetic materials such as irregular-shaped carriers, ferrite coat carriers, and spherical coat carriers, to give a developer composition.

In other words, the developer composition of the present invention comprises a magnetic carrier and the toner for electrophotography obtained above carried thereon.

In the toner for electrophotography and the developer composition of the present invention, since the toner of the present invention has a low molecular weight despite its toughness, non-contact heat-fixing methods such as flash fusing methods and oven fixing methods are also applicable, in addition to the contact heat-fixing methods such as heat-and-pressure fixing method.

EXAMPLES

The present invention will be hereinafter described in more detail by means of the following production examples, working examples, comparative examples, and test example, without intending to restrict the scope of the present invention thereto.

| Production Example 1: (Production of Resin A) | |
|---|---|
| Polyoxypropylene(2.2)-2,2-bis(4-hydroxyphenyl)propane | 700 g |
| Polyoxyethylene(2.2)-2,2-bis(4-hydroxyphenyl)propane | 975 g |
| Fumaric acid | 435 g |
| Dimethyl terephthalate | 194 g |
| Hydroquinone | 1 g |

The above starting materials having a fumaric acid content of 90 mol % in the entire acid component were placed into a three-liter four-necked glass flask together with a generally used esterification catalyst (dibutyltin oxide). A thermometer, a stainless steel stirring rod, a reflux condenser, and a nitrogen inlet tube were attached to the flask, and the mixture was heated while stirring in a mantle heater under a nitrogen stream under the conditions of 230° C. and normal pressure for the first-half of the reaction, and 200° C. and reduced pressure for the second-half of the reaction.

The resulting linear polyester resin had an acid value of 7.1 KOH mg/g, a hydroxyl value of 13.5 KOH mg/g, a softening point determined by koka-type flow tester of 108.6° C., a flow beginning temperature of 82.8° C., and a pulverization index of 22.8.

| Production Example 2: (Production of Resin B) | |
|---|---|
| Polyoxypropylene(2.2)-2,2-bis(4-hydroxyphenyl)propane | 1575 g |
| Polyoxyethylene(2.2)-2,2-bis(4-hydroxyphenyl)propane | 163 g |
| Fumaric acid | 389 g |
| Adipic acid | 263 g |
| Hydroquinone | 1 g |

The above starting materials having a total content of fumaric acid and adipic acid of 100 mol % in the entire acid component were used, and the reaction was proceeded by a similar method as in Production Example 1 using a similar apparatus as above.

The resulting linear polyester resin had an acid value of 15.8 KOH mg/g, a hydroxyl value of 14.1 KOH mg/g, a softening point determined by koka-type flow tester of 105.1° C., a flow beginning temperature of 83.2° C., and a pulverization index of 31.4.

| Production Example 3: (Production of Resin C) | |
|---|---|
| Polyoxypropylene(2.2)-2,2-bis(4-hydroxyphenyl)propane | 875 g |
| Polyoxyethylene(2.2)-2,2-bis(4-hydroxyphenyl)propane | 813 g |
| Terephthalic acid | 249 g |
| Isophthalic acid | 125 g |
| Fumaric acid | 290 g |
| Hydroquinone | 1 g |

The above starting materials having a fumaric acid content of 52 mol % in the entire acid component were used, and the reaction was proceeded by a similar method as in Production Example 1 using a similar apparatus as above.

The resulting linear polyester resin had an acid value of 5.9 KOH mg/g, a hydroxyl value of 19.8 KOH mg/g, a softening point determined by koka-type flow tester of 107.8° C., a flow beginning temperature of 89.9° C., and a pulverization index of 25.8.

| Production Example 4: (Production of Resin D) | |
|---|---|
| Polyoxypropylene(2.2)-2,2-bis(4-hydroxyphenyl)propane | 1050 g |
| Ethylene glycol | 115 g |
| Propylene glycol | 110 g |
| Terephthalic acid | 498 g |
| Fumaric acid | 258 g |
| Adipic acid | 131 g |
| Hydroquinone | 1 g |

The above starting materials having a total content of fumaric acid and adipic acid of 51 mol % in the entire acid component were used, and the reaction was proceeded by a similar method as in Production Example 1 using a similar apparatus as above.

The resulting linear polyester resin had an acid value of 10.7 KOH mg/g, a hydroxyl value of 11.7 KOH mg/g, a softening point determined by koka-type flow tester of 101.8° C., a flow beginning temperature of 75.8° C., and a pulverization index of 17.8.

| Production Example 5: (Production of Resin E: For Comparison) | |
|---|---|
| Polyoxypropylene(2.2)-2,2-bis(4-hydroxyphenyl)propane | 980 g |
| Ethylene glycol | 174 g |
| Neopentyl glycol | 146 g |
| Fumaric acid | 447 g |
| Terephthalic acid | 581 g |
| Hydroquinone | 1 g |

The above starting materials having a fumaric acid content of 52 mol % in the entire acid component were used, and the reaction was proceeded by a similar method as in Production Example 1 using a similar apparatus as above.

The resulting linear polyester resin had an acid value of 30.1 KOH mg/g, a hydroxyl value of 21.3 KOH mg/g, a softening point determined by koka-type flow tester of 98.3° C., a flow beginning temperature of 73.2° C., and a pulverization index of 6.2.

| Production Example 6: (Production of Resin F: For Comparison) | |
|---|---|
| Polyoxypropylene(2.2)-2,2-bis(4-hydroxyphenyl)propane | 700 g |
| Polyoxyethylene(2.2)-2,2-bis(4-hydroxyphenyl)propane | 975 g |
| Terephthalic acid | 332 g |
| Fumaric acid | 255 g |
| Trimellitic acid anhydride | 115 g |
| Hydroquinone | 1 g |

The above starting materials having a fumaric acid content of 46 mol % in the entire acid component were used, and the reaction was proceeded by a similar method as in Production Example 1 using a similar apparatus as above.

The resulting crosslinked polyester resin had an acid value of 27.8 KOH mg/g, a hydroxyl value of 15.1 KOH mg/g, a softening point determined by koka-type flow tester of 107.2° C., a flow beginning temperature of 79.8° C., and a pulverization index of 18.8.

| Production Example 7: (Production of Resin G) | |
|---|---|
| Polyoxypropylene(2.2)-2,2-bis(4-hydroxyphenyl)propane | 788 g |
| Polyoxyethylene(2.2)-2,2-bis(4-hydroxyphenyl)propane | 813 g |
| Ethylene glycol | 16 g |
| Terephthalic acid | 332 g |
| Adipic acid | 22 g |
| Fumaric acid | 273 g |
| Hydroquinone | 1 g |

The above starting materials having a total content of fumaric acid and adipic acid of 56 mol % in the entire acid component were used, and the reaction was proceeded by a similar method as in Production Example 1 using a similar apparatus as above.

The resulting linear polyester resin had an acid value of 5.5 KOH mg/g, a hydroxyl value of 31.2 KOH mg/g, a softening point determined by koka-type flow tester of 101.2° C., a flow beginning temperature of 74.3° C., and a pulverization index of 15.7.

| Production Example 8: (Production of Resin H, for Comparison) | |
|---|---|
| Polyoxypropylene(2.2)-2,2-bis(4-hydroxyphenyl)propane | 1225 g |
| Polyoxyethylene(2.2)-2,2-bis(4-hydroxyphenyl)propane | 488 g |
| Isophthalic acid | 166 g |
| Terephthalic acid | 415 g |
| Fumaric acid | 168 g |
| Hydroquinone | 1 g |

The above starting materials having a fumaric acid content of 29 mol % in the entire acid component were used, and the reaction was proceeded by a similar method as in Production Example 1 using a similar apparatus as above.

The resulting linear polyester resin had an acid value of 7.8 KOH mg/g, a hydroxyl value of 29.8 KOH mg/g, a softening point determined by koka-type flow tester of 104.8° C., a flow beginning temperature of 79.1° C., and a pulverization index of 9.8.

Example 1

The materials having the following composition was mixed using a ball-mill, and the mixture was melt-blended using a pressure kneader. After cooling the melt-blended mixture, the mixture was pulverized and classified by conventional methods, to give a color toner having an average particle size of 8 μm.

| | |
|---|---|
| Resin A | 100 parts by weight |
| C.I. Pigment Red 11 | 5 parts by weight |
| Viscol 550P (manufactured by Sanyo Chemical Industries, Ltd.) | 2 parts by weight |

0.3 parts by weight of a hydrophobic silica "AEROZIL R-972" (manufactured by Nippon Aerozil Ltd.) were added to 100 parts by weight of untreated toner obtained above, to give Toner 1.

Example 2

Similar procedures to Example 1 were carried out up to the surface treatment step except that Resin A was replaced with Resin B, to give Toner 2.

Example 3

Similar procedures to Example 1 were carried out up to the surface treatment step except that Resin A was replaced with Resin C, to give Toner 3.

Example 4

Similar procedures to Example 1 were carried out up to the surface treatment step except that Resin A was replaced with Resin D, to give Toner 4.

Example 5

| | |
|---|---|
| Resin A | 100 parts by weight |
| C.I. Pigment Blue 15:3 | 5 parts by weight |
| Viscol 550P (manufactured by Sanyo Chemical Industries, Ltd.) | 2 parts by weight |

0.3 parts by weight of a hydrophobic silica "AEROZIL R-972" (manufactured by Nippon Aerozil Ltd.) were added to 100 parts by weight of untreated toner obtained in the same manner to Example 1 using the above materials, to give Toner 5.

Example 6

Similar procedures to Example 5 were carried out up to the surface treatment step except that Resin A was replaced with Resin B, to give Toner 6.

Example 7

Similar procedures to Example 5 were carried out up to the surface treatment step except that Resin A was replaced with Resin C, to give Toner 7.

Example 8

Similar procedures to Example 5 were carried out up to the surface treatment step except that Resin A was replaced with Resin D, to give Toner 8.

Example 9

Similar procedures to Example 1 were carried out up to the surface treatment step except that Resin A was replaced with Resin G, to give Toner 9.

Example 10

Similar procedures to Example 5 were carried out up to the surface treatment step except that Resin A was replaced with Resin G, to give Toner 10.

Comparative Example 1

Similar procedures to Example 1 were carried out up to the surface treatment step except that Resin A was replaced with Resin E, to give Comparative Toner 1.

Comparative Example 2

Similar procedures to Example 1 were carried out up to the surface treatment step except that Resin A was replaced with Resin F, to give Comparative Toner 2.

Comparative Example 3

Similar procedures to Example 1 were carried out up to the surface treatment step except that Resin A was replaced with styrene-acrylic copolymer resin for toner binder (non-crosslinking type; softening point determined by koka-type flow tester: 108.3° C.; flow beginning temperature 81.2° C.; and pulverization index 4.8), to give Comparative Toner 3.

Comparative Example 4

Similar procedures to Example 5 were carried out up to the surface treatment step except that Resin A was replaced with Resin E, to give Comparative Toner 4.

Comparative Example 5

Similar procedures to Example 5 were carried out up to the surface treatment step except that Resin A was replaced with Resin F, to give Comparative Toner 5.

Comparative Example 6

Similar procedures to Example 5 were carried out up to the surface treatment step except that Resin A was replaced with styrene-acrylic copolymer resin for toner binder (non-crosslinking type; softening point determined by koka-type flow tester: 108.3° C.; flow beginning temperature 81.2° C.; and pulverization index 4.8), to give Comparative Toner 6.

Comparative Example 7

Similar procedures to Example 1 were carried out up to the surface treatment step except that Resin A was replaced with Resin H, to give Comparative Toner 7.

Comparative Example 8

Similar procedures to Example 5 were carried out up to the surface treatment step except that Resin A was replaced with Resin H, to give Comparative Toner 8.

Test Example

Toners 1 to 10 obtained in Examples 1 to 10 and Comparative Toners 1 to 8 obtained in Comparative Examples 1 to 8 were used to carry out the tests explained below in detail.

Here, each of the toners was used in the form a two-component developer by blending a toner with a magnetite carrier having an average particle size of 70 μm in a proportion of 5/95.

Each of the tests was carried out by loading each of the above developers in a commercially available electrophotographic copy machine (CX7700, manufactured by Sharp Corporation) and copying given number of sheets. In the copy machine, an organic photoconductor was used for a photoconductor, and a silicone roller equipped with oil-coating device was used for a fixing roller, the rotational speed of the fixing roller being 100 mm/sec.

(1) Triboelectric charge:

The triboelectric charge was measured by a blow-off type electric charge measuring device equipped with a Faraday cage, a capacitor and an electrometer as described below.

First, W (g) (about 0.15 to 0.20 g) of the developer prepared above is placed into a brass measurement cell equipped with a stainless screen of 500 mesh, which is adjustable to any mesh size to block the passing of the carrier particles. Next, after aspirating from a suction opening for 5 seconds, blowing is carried out for 5 seconds under a pressure indicated by a barometric regulator of 0.6 kgf/cm$^2$, to thereby selectively remove only the toner from the cell.

In this case, the voltage of the electrometer after 2 seconds from the start of blowing is defined as V (volt). Here, when the electric capacitance of the capacitor is defined as C (μF), the triboelectric charge Q/m of this toner can be calculated by the following equation:

$$Q/m(\mu C/g)=C\times V/m$$

Here, m is the weight of the toner contained in W (g) of the developer. When the weight of the toner in the developer is defined as T (g) and the weight of the developer as D (g), the toner concentration in a given sample can be expressed as T/D×100(%), and m can be calculated as shown in the following equation:

$$m(g)=W\times(T/D).$$

(2) Image density:

The image densities of initially formed image and that of the formed images after copying 10,000 sheets were measured by a reflective densitometer "RD-915" (manufactured by Macbeth Process Measurements Co.).

(3) Background:

The background of the initial formed image and that of the formed image after copying 10,000 sheets was evaluated as follows by using a spectrophotometer "SZ-Σ90" (manufactured by Nippon Denshoku Kogyo Kabushiki Kaisha).

○: Less than 1.0; and x: Not more than 1.0.

(4) Transparency:

The transparency of the resin was evaluated as follows by projecting a copy of Chart No. 22 of Gazo Denshi Gakkai and measuring spectropermeability at 400 nm to 70 nm:

○: Difference between a max. permeability and a min. permeability being not more than 50%; and x: Difference between a max. permeability and a min. permeability being less than 50%.

Incidentally, a poor smoothness of the fixed image surface after fixing leads to a poor transparency, whether or not a smooth fixed image surface is obtained by the resulting toner can be determined by the evaluation of the transparency.

(5) Fixing ability:

The fixing ability was evaluated using a fixed image at a temperature of 180° C. and a rotational speed of 160 mm/sec as follows.

Specifically, this fixing ratio of the toner is determined by placing a load of 500 g on a sand-rubber eraser (LION No. 502) having a bottom area of 15 mm×7.5 mm which contacts the fixed toner image, placing the loaded eraser on the fixed toner image, moving the loaded eraser on the image backward and forward five times, measuring the optical reflective density of the eraser-treated image with a reflective densitometer manufactured by Macbeth Process Measurements Co.), and then calculating the fixing ratio from this density value and a density value before the eraser treatment using the following equation.

$$\text{Fixing ratio (\%)} = \frac{\text{Image density after eraser treatment}}{\text{Image density before eraser treatment}} \times 100$$

○: Those having a fixing ratio of not more than 70%; and x: Those having a fixing ratio of less than 70%.

(6) Environmental stability:

10,000 sheet continuous copy tests were carried out under normal environmental conditions (23° C., 50% RH), high-temperature, high-humidity conditions (35° C., 85% RH), and low-temperature, low-humidity conditions (10° C., 15% RH). Percent change in triboelectric charge in the durability printing test was evaluated as follows:

○: Those having a percent change of less than 30%; and x: Those having a percent change of not less than 30%.

The results of tests (1) to (6) are summarized in Table 1.

TABLE 1

| | Initial Properties | | | Properties after Copying 10,000 Sheets | | | | | |
|---|---|---|---|---|---|---|---|---|---|
| | Tribo-electric Charge | Image Density | Back-ground | Tribo-electric Charge | Image Density | Back-ground | Trans-parency | Fixing Ability | Environ-mental Stability |
| Examples | | | | | | | | | |
| Example 1 | 16.5 | 1.67 | ○ | 17.1 | 1.64 | ○ | ○ | ○ | ○ |
| Example 2 | 17.8 | 1.58 | ○ | 17.5 | 1.52 | ○ | ○ | ○ | ○ |
| Example 3 | 15.8 | 1.68 | ○ | 16.3 | 1.65 | ○ | ○ | ○ | ○ |
| Example 4 | 17.2 | 1.60 | ○ | 15.9 | 1.54 | ○ | ○ | ○ | ○ |
| Example 5 | 16.2 | 1.65 | ○ | 15.5 | 1.64 | ○ | ○ | ○ | ○ |
| Example 6 | 17.2 | 1.59 | ○ | 16.8 | 1.55 | ○ | ○ | ○ | ○ |
| Example 7 | 15.5 | 1.69 | ○ | 16.8 | 1.59 | ○ | ○ | ○ | ○ |
| Example 8 | 17.1 | 1.62 | ○ | 15.1 | 1.55 | ○ | ○ | ○ | ○ |
| Example 9 | 15.5 | 1.71 | ○ | 14.5 | 1.76 | ○ | ○ | ○ | ○ |
| Example 10 | 15.8 | 1.69 | ○ | 15.0 | 1.70 | ○ | ○ | ○ | ○ |
| Comparative Examples | | | | | | | | | |
| C. Example 1 | 18.3 | 1.55 | ○ | 9.8 | 1.85 | X | ○ | ○ | X |
| C. Example 2 | 16.2 | 1.64 | ○ | 16.5 | 1.67 | ○ | X | X | ○ |
| C. Example 3 | 15.8 | 1.70 | ○ | 8.2 | 1.90 | X | ○ | ○ | ○ |
| C. Example 4 | 17.9 | 1.57 | ○ | 9.5 | 1.88 | X | ○ | ○ | X |
| C. Example 5 | 16.8 | 1.67 | ○ | 16.5 | 1.63 | ○ | X | X | ○ |
| C. Example 6 | 15.4 | 1.71 | ○ | 8.5 | 1.92 | X | ○ | ○ | ○ |
| C. Example 7 | 15.4 | 1.72 | ○ | 9.9 | 1.88 | X | ○ | ○ | ○ |
| C. Example 8 | 15.9 | 1.71 | ○ | 9.7 | 1.87 | X | ○ | ○ | ○ |

As clearly shown by the above results, since toners obtained in Examples 1 to 10 had excellent impact resistance, their triboelectric charges and image densities were able to be maintained for a long period of use, without causing background in the formed images. Also, the binder resins used in Examples 1 to 10 gave high transparency, and the resulting toners were fixable at a low temperature, only slightly affected even by severe conditions of high-temperature, high-humidity conditions and low-temperature, low-humidity conditions.

By contrast, in cases of Comparative Examples 1 and 4, where a binder resin having a small pulverization index, the triboelectric charge was drastically lowered, thereby causing background in the formed images and making environmental stability of the toner poor. In cases of Comparative Examples 2 and 5, where a crosslinked polyester resin was used, the binder resin gave a low transparency and a poor low-temperature fixing ability. In cases of Comparative Examples 3 and 6, where a styrene-acrylic copolymer resin was used, the triboelectric charges of the toners were drastically lowered, and thereby the background of the formed images was caused. In cases of Comparative Examples 7 and 8, where a linear polyester having a smaller pulverization index was used, the triboelectric charges of the toners were lowered, and thereby the background of the formed images was caused.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for electrophotography comprising at least a binder resin and a colorant, the binder resin containing 90–100% by weight of a linear polyester and having a pulverization index of from 14 to 40, wherein said pulverization index is obtained by the following steps:

(a) pulverizing and classifying the binder resin to obtain a 16-mesh pass and 20-mesh on resin powder;

(b) accurately weighing classified binder resin powder obtained in step (a) in an amount of 10.00 g;

(c) pulverizing weighed binder resin powder obtained in step (b) with a mill for 10 seconds;

(d) classifying pulverized binder resin powder obtained in step (c) with a 30-mesh opening sieve;

(e) accurately weighing a weight of 30-mesh on resin powder (A) expressed in grams;

(f) calculating a residual ratio by the following equation from the value of A:

$$\text{Residual Ratio (\%)} = \frac{(A)\,g}{\text{Weight of Resin before Mill Pulverization}} \times 100$$

(g) repeating steps (a) to (f) three times and taking an average value of the obtained residual ratios; and (h) defining the average value as the pulverization index.

2. The toner for electrophotography according to claim 1, wherein said linear polyester is obtainable by a condensation polymerization between an alcohol component and an acid component containing an aliphatic dicarboxylic acid in an amount of not less than 40 mol % of the entire acid component.

3. The toner for electrophotography according to claim 2, wherein said aliphatic dicarboxylic acid is selected from the group consisting of aliphatic unsaturated dicarboxylic acids, such as maleic acid, fumaric acid, citraconic acid, iraconic acid, glutaconic acid, and alkenylsuccinic acids, such as n-dodecenylsuccinic acid; and aliphatic saturated dicarboxylic acids, such as succinic acid, adipic acid, sebacic acid, azelaic acid, malonic acid, alkylsuccinic acids, such as n-dodecylsuccinic acid.

4. The toner for electrophotography according to claim 1, wherein said linear polyester has an acid value of not more than 40 KOH mg/g and a hydroxyl value of not more than 40 KOH mg/g.

5. The toner for electrophotography according to claim 1, wherein said linear polyester has a softening temperature determined by a koka-type flow tester of from 80° C. to 120° C., and a temperature difference between a flow beginning temperature and the softening temperature of from 10° to 40° C.

6. The toner for electrophotography according to claim 1, wherein the amount of said linear polyester contained in said binder resin is 70 to 100% by weight.

7. The toner for electrophotography according to claim 1, wherein said linear polyester has a pulverization index of 14 to 40.

8. The toner for electrophotography according to claim 1, wherein the toner for electrophotography is a color toner.

9. The toner for electrophotography according to claim 1, for use in a non-contact heat-fixing method.

10. A developer composition comprising a magnetic carrier and the toner for electrophotography according to claim 1.

* * * * *